US005091946A

United States Patent [19]

Ozawa

[11] Patent Number: 5,091,946

[45] Date of Patent: Feb. 25, 1992

[54] COMMUNICATION SYSTEM CAPABLE OF IMPROVING A SPEECH QUALITY BY EFFECTIVELY CALCULATING EXCITATION MULTIPULSES

[75] Inventor: Kazunori Ozawa, Tokyo, Japan

[73] Assignee: NEC Corporation, Tokyo, Japan

[21] Appl. No.: 455,025

[22] Filed: Dec. 22, 1989

[30] Foreign Application Priority Data

Dec. 23, 1988 [JP] Japan ..... 63-326805
Jan. 6, 1989 [JP] Japan ..... 1-1849

[51] Int. Cl.[5] ..... G10L 5/00

[52] U.S. Cl. ..... 381/36; 381/40; 381/38; 381/51

[58] Field of Search ..... 381/29-53; 364/513.5

[56] References Cited

U.S. PATENT DOCUMENTS 4,797,926 1/1989 Bronson et al. ..... 381/36
4,881,267 11/1989 Taguch ..... 381/40

*Primary Examiner*—Emanuel S. Kemeny

*Attorney, Agent, or Firm*—Sughrue, Mion, Zinn, Macpeak & Seas

[57] ABSTRACT

In an encoder device for encoding a sequence of digital speech signals classified into a voiced sound and an unvoiced sound into a sequence of output signals, by the use of a spectrum parameter and pitch parameters, at every frame having N samples where N represents an integer, a judging circuit judges whether the digital speech signals are classified into the voiced sound or the unvoiced sound to produce a judged signal representative of a result of judging. A processing unit processes the digital speech signals in accordance with the judged signal to selectively produce a first set of primary sound source signals and a secondary sound source signals. The first set of primary sound source signals are produced when the judged signal represents the voiced sound and are representative of locations and amplitudes of a first set of excitation multipulses calculated at every frame. The second set of secondary sound source signals are produced when the judged signal represents the unvoiced sound and are representative of the amplitudes of a second set of excitation multipulses each of which is located at intervals of a preselected number of the samples.

8 Claims, 5 Drawing Sheets

COMMUNICATION SYSTEM CAPABLE OF IMPROVING A SPEECH QUALITY BY EFFECTIVELY CALCULATING EXCITATION MULTIPULSES

BACKGROUND OF THE INVENTION

This invention relates to a communication system which comprises an encoder device for encoding a sequence of input digital speech signals into a set of excitation multipulses and/or a decoder device communicable with the encoder device.

As known in the art, a conventional communication system of the type described is helpful for transmitting a speech signal at a low transmission bit rate, such as 4.8 kb/s from a transmitting end to a receiving end. The transmitting and the receiving ends comprise an encoder device and a decoder device which are operable to encode and decode the speech signals, respectively, in the manner which will presently be described more in detail. A wide variety of such systems have been proposed to improve a speech quality reproduced in the decoder device and to reduce a transmission bit rate.

Among others, there has been known a pitch interpolation multipulse system which has been proposed in Japanese Unexamined Patent Publications Nos. Syô 61-15000 and 62-038500, namely, 15000/1986 and 038500/1987 which may be called first and second references, respectively. In this pitch interpolation multipulse system, the encoder device is supplied with a sequence of input digital speech signals at every frame of, for example, 20 milliseconds and extracts a spectrum parameter and a pitch parameter which will be called first and second primary parameters, respectively. The spectrum parameter is representative of a spectrum envelope of a speech signal specified by the input digital speech signal sequence while the pitch parameter is representative of a pitch of the speech signal. Thereafter, the input digital speech signal sequence is classified into a voiced sound and an unvoiced sound which last for voiced and unvoiced durations, respectively. In addition, the input digital speech signal sequence is divided at every frame into a plurality of pitch durations which may be referred to as subframes, respectively. Under the circumstances, operation is carried out in the encoder device to calculate a set of excitation multipulses representative of a sound source signal specified by the input digital speech signal sequence.

More specifically, the sound source signal is represented for the voiced duration by the excitation multipulse set which is calculated with respect to a selected one of the pitch durations that may be called a representative duration. From this fact, it is understood that each set of the excitation multipulses is extracted from intermittent ones of the subframes. Subsequently, an amplitude and a location of each excitation multipulse of the set are transmitted from the transmitting end to the receiving end along with the spectrum and the pitch parameters. On the other hand, a sound source signal of a single frame is represented for the unvoiced duration by a small number of excitation multipulses and a noise signal. Thereafter, the amplitude and the location of each excitation multipulse is transmitted for the unvoiced duration together with a gain and an index of the noise signal. At any rate, the amplitudes and the locations of the excitation multipulses, the spectrum and the pitch parameters, and the gains and the indices of the noise signals are sent as a sequence of output signals from the transmitting end to a receiving end comprising a decoder device.

On the receiving end, the decoder device is supplied with the output signal sequence as a sequence of reception signals which carries information related to sets of excitation multipulses extracted from frames, as mentioned above. Let consideration be made about a current set of the excitation multipulses extracted from a representative duration of a current one of the frames and a next set of the excitation multipulses extracted from a representative duration of a next one of the frames following the current frame. In this event, interpolation is carried out for the voiced duration by the use of the amplitudes and the locations of the current and the next sets of the excitation multipulses to reconstruct excitation multipulses in the remaining subframes except the representative durations and to reproduce a sequence of driving sound source signals for each frame. On the other hand, a sequence of driving sound source signals for each frame is reproduced for an unvoiced duration by the use of indices and gains of the excitation multipulses and the noise signals.

Thereafter, the driving sound source signals thus reproduced are given to a synthesis filter formed by the use of a spectrum parameter and are synthesized into a synthesized speech signal.

With this structure, each set of the excitation multipulses is intermittently extracted from each frame in the encoder device and is reproduced into the synthesized speech signal by an interpolation technique in the decoder device. Herein, it is to be noted that intermittent extraction of the excitation multipulses makes it difficult to reproduce the driving sound source signal in the decoder device at a transient portion at which the sound source signal is changed in its characteristic. Such a transient portion appears when a vowel is changed to another vowel on concatenation of vowels in the speech signal and when a voiced sound is changed to another voiced sound. In a frame including such a transient portion, the driving sound source signals reproduced by the use of the interpolation technique is terribly different from actual sound source signals, which results in degradation of the synthesized speech signal in quality.

It is mentioned here that the spectrum parameter for a spectrum envelope is generally calculated in an encoder device by analyzing the input digital speech signals by the use of a linear prediction coding (LPC) technique and is used in a decoder device to form a synthesis filter. Thus, the synthesis filter is formed by the spectrum parameter derived by the use of the linear prediction coding technique and has a filter characteristic determined by the spectrum envelope. However, when female sounds, in particular, "i" and "u" are analyzed by the linear prediction coding technique, it has been pointed out that an adverse influence appears in a fundamental wave and its harmonic waves of a pitch frequency. Accordingly, the synthesis filter has a band width which is narrower than a practical band width determined by a spectrum envelope of practical speech signals. Particularly, the band width of the synthesis filter becomes extremely narrow in a frequency band which corresponds to a first formant frequency band. As a result, no periodicity of a pitch appears in a sound source signal. Therefore, the speech quality of the synthesized speech signal is unfavorably degraded when the sound speech signals are represented by the excitation multipulses extracted by the use of the interpolation technique on the assumption of the periodicity of the sound source.

SUMMARY OF THE INVENTION

It is an object of this invention to provide a communication system which is capable of improving a speech quality when input digital speech signals are encoded at a transmitting end and reproduced at a receiving end.

It is another object of this invention to provide an encoder which is used in the transmitting end of the communication system and which can encode the input digital speech signals into a sequence of output signals at a comparatively small amount of calculation so as to improve the speech quality.

It is still another object of this invention to provide a decoder device which is used in the receiving end and which can reproduce a synthesized speech signal at a high speech quality.

An encoder device to which this invention is applicable is supplied with a sequence of digital speech signals at every frame to produce a sequence of output signals. Each of the frame has N samples per a single frame where N represents an integer. The digital speech signals are classified into a voiced sound and an unvoiced sound. The encoder device comprises parameter calculation means responsive to the digital speech signals for calculating first and second parameters which specify a spectrum envelope and pitch parameters of the digital speech signals at every frame to produce first and second parameter signals representative of the spectrum envelope and the pitch parameters, respectively, pulse calculation means coupled to the parameter calculation means for calculating a set of calculation result signals representative of the digital speech signals, and output signal producing means for producing the set of the calculation result signals as the output signal sequence.

According to this invention, the encoder device comprises judging means operable in cooperation with the parameter calculation means for judging whether the digital speech signals are classified into the voiced sound or the unvoiced sound at every frame to produce a judged signal representative of a result of judging the digital speech signals. The pulse calculation means comprises processing means supplied with the digital speech signals, the first and the second parameter signals, and the judged signal for processing the digital speech signals in accordance with the judged signal to selectively produce a first set of primary sound source signals and a second set of secondary sound source signals different from the first set of the primary sound source signals. The first set of the primary sound source signals are representative of locations and amplitudes of a first set of excitation multipulses calculated at every frame. The second set of the secondary sound source signals are representative of the amplitudes of a second set of excitation multipulses each of which is located at intervals of a preselected number of the samples. The encoder device further comprises means for supplying a combination of the first and the second parameter signals, the judged signal, and the primary and the secondary sound source signals to the output signal producing means as the output signal sequence.

DESCRIPTION OF THE PREFERRED EMBODIMENT

Figure 1:
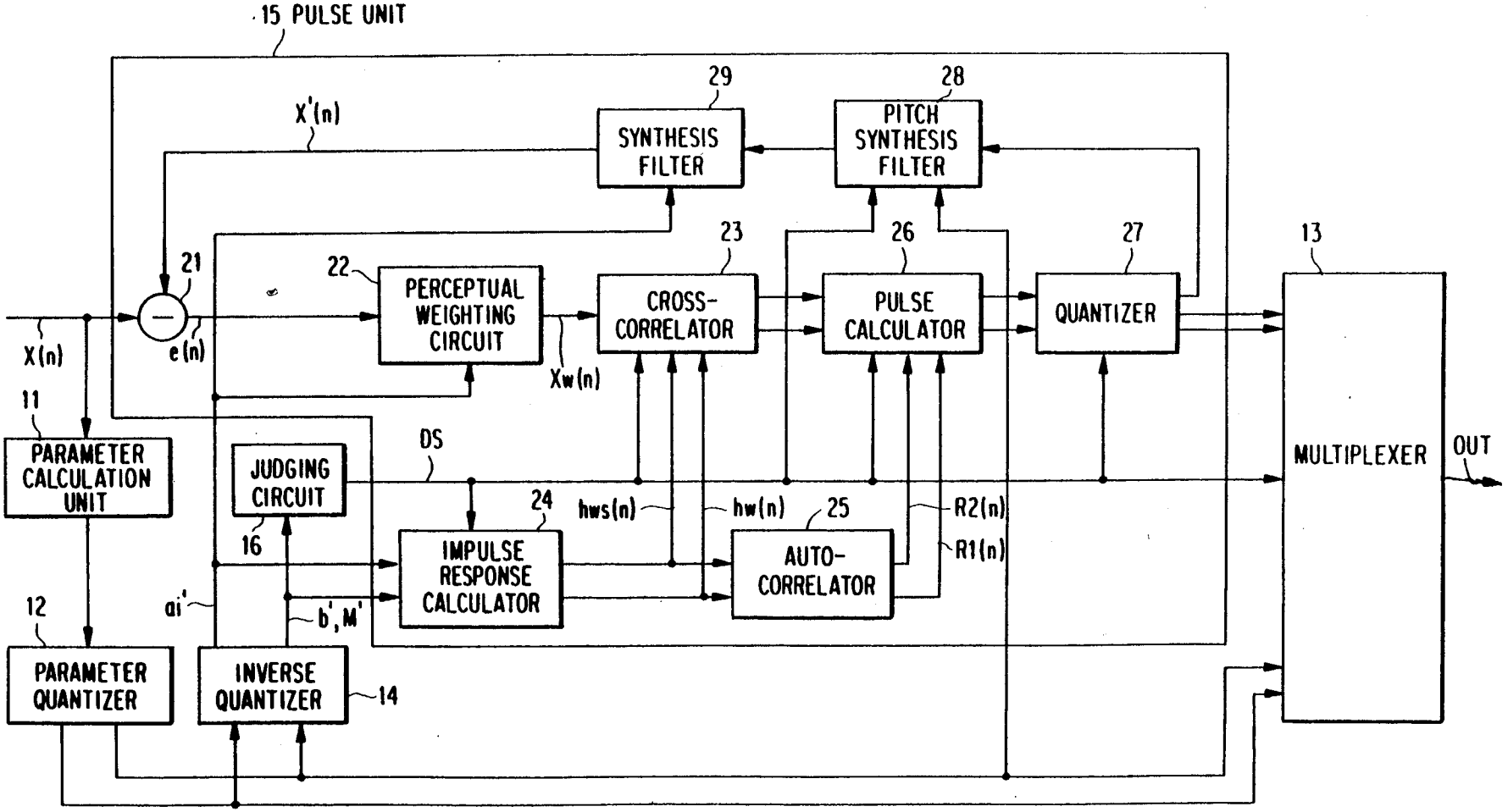
FIG. 1 is a block diagram of an encoder device according to a first embodiment of this invention.

Referring to FIG. 1, an encoder device according to a first embodiment of this invention is supplied with a sequence of input digital speech signals X(n) to produce a sequence of output signals OUT where n represents sampling instants. The input digital speech signal sequence X(n) is divisible into a plurality of frames and is assumed to be sent from an external device, such as an analog-to-digital converter (not shown) to the encoder device. The input digital speech signals X(n) carry voiced and unvoiced sounds which last for voiced and unvoiced durations, respectively. Each frame may have an interval of, for example, 20 milliseconds. The input digital speech signals X(n) supplied to a parameter calculation unit 11 at every frame. The illustrated parameter calculation unit 11 comprises an LPC analyzer (not shown) and a pitch parameter calculator (not shown) both of which are given the input digital speech signals X(n) in parallel to calculate spectrum parameters $a_1$, namely, the LPC parameters, and pitch parameters in a known manner.

Specifically, the spectrum parameters $a_i$ are representative of a spectrum envelope of the input digital speech signals X(n) at every frame and may be collectively called a spectrum parameter. The LPC analyzer analyzes the input digital speech signals by the use of a linear prediction coding technique known in the art to calculate only first through P-th orders of spectrum parameters. Calculation of the spectrum parameters is described in detail in Japanese Unexamined Patent Publication No. Syô 60-51900, namely, 51900/1985 which may be called a third reference. At any rate, the spectrum parameters calculated in the LPC analyzer are sent to a parameter quantizer 12 and are quantized into quantized spectrum parameters each of which is composed of a predetermined number of bits. Alternatively, the quantization may be carried out by the other known methods, such as scalar quantization, and vector quantization. The quantized spectrum parameters are delivered to a multiplexer 13. Furthermore, the quantized spectrum parameters are converted by an inverse quantizer 14 which carries out inverse quantization relative to quantization of the parameter quantizer 12 into converted spectrum parameters $a_i'$ ($i=1\sim P$). The converted spectrum parameters $a_i'$ are supplied to a pulse calculation unit 15. The quantized spectrum parameters and the converted spectrum parameters $a_i'$ come from the spectrum parameters calculated by the LPC analyzer and are produced in the form of electric signals which may be collectively called a first parameter signal.

In the parameter calculation unit 11, the pitch parameter calculator calculates an average pitch period M and pitch coefficients b from the input digital speech signals X(n) to produce, as the pitch parameters, the average pitch period M and the pitch coefficients b at every frame by an autocorrelation method which is also described in the third reference and which therefore will not be mentioned hereinunder. Alternatively, the pitch parameters may be calculated by the other known methods, such as a cepstrum method, a SIFT method, a modified correlation method. In any event, the average pitch period M and the pitch coefficients b are also quantized by the parameter quantizer 12 into a quantized pitch period and quantized pitch coefficients each of which is composed of a preselected number of bits. The quantized pitch period and the quantized pitch coefficients are sent as electric signals. In addition, the quantized pitch period and the quantized pitch coefficients are also converted by the inverse quantizer 14 into a converted pitch period M' and converted pitch coefficients b' which are produced in the form of electric signals. The quantized pitch period and the quantized pitch coefficients are sent to the multiplexer 13 as a second parameter signal representative of the pitch period and the pitch coefficients.

By the use of the converted pitch coefficients b', a judging circuit 16 judges whether the input digital speech signals X(n) are classified into the voiced sound or the unvoiced sound at every frame. More exactly, the judging circuit 16 compares the converted pitch coefficients b' with a predetermined level at every frame and produces a judged signal depicted at DS at every frame. The judging circuit 16 produces the judged signal DS representative of voiced sound information when the converted pitch coefficients b' is higher than the predetermined level. Otherwise, the judging circuit 16 produces the judged signal DS representative of unvoiced sound information. The judged signal DS is supplied to the pulse calculation unit 15.

In the example being illustrated, the pulse calculation unit 15 is supplied with the input digital speech signals X(n) at every frame along with the converted spectrum parameters $a_i'$, the converted pitch period M', the converted pitch coefficients b', and the judged signal DS to selectively produce a first set of primary sound source signals and a second set of secondary sound source signals different from the first set of primary sound source signals in a manner to be described later. To this end, the pulse calculation unit 15 comprises a subtracter 21 responsive to the input digital speech signals X(n) and a sequence of local synthesized speech signals X'(n) to produce a sequence of error signals e(n) representative of differences between the input digital and the local synthesized speech signals X(n) and X'(n). The error signals e(n) are sent to a perceptual weighting circuit 22 which is supplied with the converted spectrum parameters $a_i'$. In the perceptual weighting circuit 22, the error signals e(n) are weighted by weights which are determined by the converted spectrum parameters $a_i'$. Thus, the perceptual weighting circuit 22 calculates a sequence of weighted errors in a known manner to supply the weighted errors $X_w(n)$ to a cross-correlator 23.

On the other hand, the converted spectrum parameters $a_i'$ are also sent from the inverse quantizer 14 to an impulse response calculator 24. Supplied with the converted spectrum parameters $a_i'$, the converted pitch period M', the converted pitch coefficients b', and the judged signal DS, the impulse response calculator 24 calculates a primary impulse response $h_w(n)$ of a filter having a transfer function H(Z) specified by the following equation (1) by the use of the converted spectrum parameters $a_i'$, the converted pitch period M', and the converted pitch coefficients b' when the judged signal DS represents the voiced sound information.

$$H(Z)=1/\{(1-b'Z^{-M'})\}\{(1-\Sigma a_i'Z^{-i})\}. \quad (1)$$

The impulse response calculator 24 also calculates a secondary impulse response $h_{ws}(n)$ of a spectrum envelope synthesis filter which are subjected to perceptual weighting and which is determined by the converted spectrum parameters $a_i'$ when the judge signal represents the unvoiced sound information. Calculation of the impulse response calculator 24 is described in detail in the third reference. The primary and the secondary impulse responses $h_{ws}(n)$ and $h_w(n)$ thus calculated are delivered to both the cross-correlator 23 and an autocorrelator 25 in the form of electrical signals which may be called primary and secondary impulse response signals, respectively.

The autocorrelator 25 calculates a primary autocorrelation or covariance function or coefficients $R_1(m)$ with reference to the primary impulse response $h_w(n)$ in a manner described in the third reference, where m represents an integer selected between unity and N both inclusive. Similarly, the autocorrelator 25 calculates a secondary autocorrelation coefficients $R_2(m)$ in accordance with the secondary impulse response $h_{ws}(n)$. The primary and the secondary autocorrelation coefficients $R_1(m)$ and $R_2(m)$ are delivered to a pulse calculator 26 in the form of electrical signals which may be called primary and secondary autocorrelation signals. When the cross-correlator 23 is given the weighted errors and the primary impulse response $h_w(n)$, the cross-correlator 23 calculates primary cross-correlation function or coefficients $\Phi_1(m)$ for a predetermined number N of samples in a well-known manner. When the cross-correlator 23 is given the weighted errors and the secondary impulse response $h_{ws}(n)$, the cross-correlator 23 calculates secondary cross-correlation function or coefficients $\Phi_2(m)$. The primary cross-correlation coefficients $\Phi_1(m)$ are delivered to the pulse calculator 26 in the form of an electric signal along with the primary autocorrelation coefficients $R_1(m)$ and the judged signal DS representative of the voiced sound information while the secondary cross-correlation coefficients $\Phi_2(m)$ are delivered to the pulse calculator 26 in the form of an electric signal along with the secondary autocorrelation coefficients $R_2(m)$ and the judged signal representative of the unvoiced sound information. The electric signals of the primary and the secondary cross-correlation coefficients $o_1(m)$ and o may be called primary and secondary cross-correlation signals. The autocorrelator 25 and the cross-correlator 26 may be similar to that described in the third reference and will not be described any longer.

On reception of the judged signal DS representing the voiced sound information, the pulse calculator 26 calculates locations and amplitudes of a first set of excitation multipulses by a pitch prediction multipulse encoding method described in the third reference. When the pulse calculator 26 receives the judged signal DS representative of the unvoiced sound information, the pulse calculator 26 calculates the amplitudes of a second set of excitation multipulses each of which is located at intervals of a preselected number of K samples in a manner which will presently be described in detail.

Figure 2:
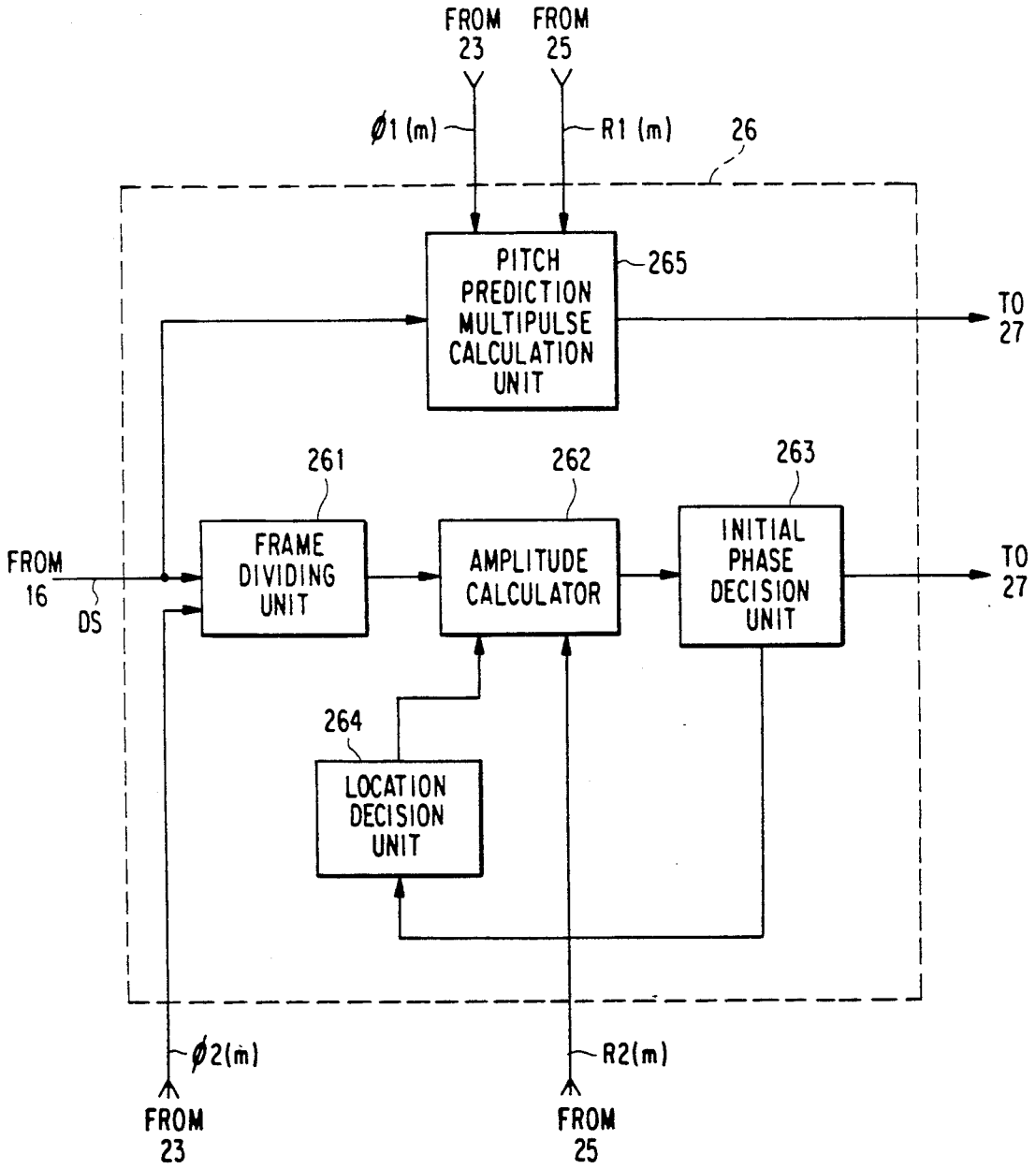
FIG. 2 is a block diagram for use in describing a pulse calculator illustrated in FIG. 1.
Figure 3:
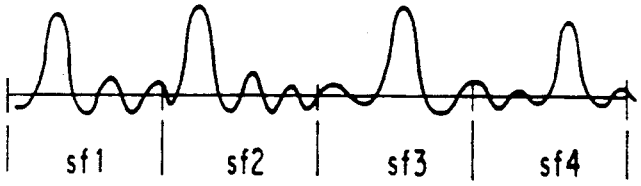
FIG. 3 is a time chart for use in describing an operation of the pulse calculator illustrated in FIG. 2.
Figure 3:
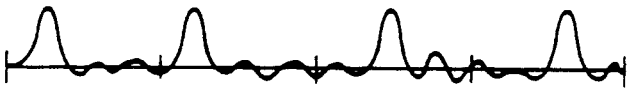
Figure 3:
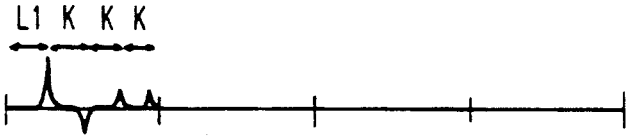
Figure 3:
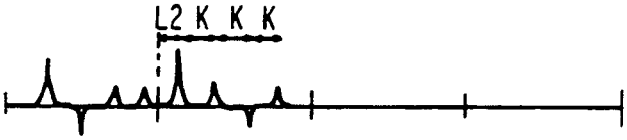

Referring to FIGS. 2 and 3 in addition to FIG. 1, the pulse calculator 26 comprises a frame dividing unit 261, an amplitude calculator 262, an initial phase decision unit 263, and a location decision unit 264 in addition to a pitch prediction multipulse calculation unit 265 described in the third reference. The pitch prediction multipulse calculation unit 265 calculates the locations and the amplitudes of the first set of excitation multipulses on reception of the judged signal DS representative of the voiced sound information. The pitch prediction multipulse calculation unit 265 produces a first set of primary sound source signals representative of the locations and the amplitudes of the first set of excitation multipulses along with the judged signal DS representative of the voiced sound information.

Supplied with the judged signal DS representative of the unvoiced sound information, the frame dividing unit 261 divides a single one of the frames into a predetermined number of subframes or pitch periods each of which is shorter than each frame of the input digital speech signals X(n) illustrated in FIG. 3(*a*) and which is equal to a predetermined duration, for example, five milliseconds. The illustrated frame is divided into first through fourth subframes sf1, sf2, sf3, and sf4. The secondary cross-correlation coefficients $\Phi_2(m)$ are illustrated in FIG. 3(*b*). The location decision unit 264 decides an i-th location $m_i$ of the excitation multipulses at intervals of the preselected number of K samples at the first subframe sf1 in accordance with the following equation given by:

$$m_i = L + (i-1)K,$$

where i represents an integer between unity and Q and L, represents an initial phase of a location in the subframe and specified by $0 \leqq L \leqq K-1$.

The amplitude calculation unit 262 calculates an i-th amplitude $g_i$ of an i-th excitation multipulse located at the i-th location in accordance with an equation given by:

$$g_i = \Phi_2(m_i) = \sum_{L=1}^{i-1} g_1 R_2(|m_i - m_1|)/R_2(0). \quad (2)$$

The ini-ial phase decision unit 263 is supplied with first through Q-th amplitudes calculated by the amplitude calculation unit 262 and decides an optimum phase which maximizes the following equation (3) given by:

$$PL = \underset{L}{\mathrm{MAX}} \sum_{i=1}^{Q} g_i. \quad (3)$$

Thus, the initial phase decision unit 263 decides a first initial phase $L_1$ at the first subframe sf1. Practically, the initial phase decision unit 263 must carry out calculation of the equation (3) M times to decide the first initial phase $L_1$. In order to reduce an amount of the calculation, the initial phase decision unit 263 may use other manners. For example, the amplitude calculation unit 262 calculates the first amplitude $g_1$ by the use of the equation (2). It is to be noted that the first amplitude $g_1$ has a maximum amplitude in the first subframe sf1. From this fact, the initial phase decision unit 263 calculates the first initial phase $L_1$ by the use of the first location $m_1$ of the first amplitude $g_1$ in accordance with the following equation given by:

$$L = MOD(m_1 - 1/K).$$

In this event, the initial phase decision unit 263 may carry out the above-described calculation once at the subframe sf1. The first initial phase $L_1$ and the amplitudes of the excitation multipulses are illustrated in FIG. 3(*c*). The illustrated pulse calculator 26 calculates the excitation multipulses of four at intervals of the preselected number of K samples per a single subframe. The initial phase decision unit 263 produces the first initial phase $L_1$ and first through fourth amplitudes of the excitation multipulses in the form of electric signals.

The above-described operation is repeated at every subframe. In FIG. 3(*d*), a second initial phase $L_2$ and first through fourth amplitudes are illustrated for the second subframe sf2 in addition to the first initial phase and the four amplitudes illustrated in FIG. 3(*c*). The pulse calculator 26 produces a second set of secondary sound source signals representative of the first through fourth initial phases $L_1$ to $L_4$ of each of the first through the fourth subframes sf1 to sf4 and the amplitudes of the second set of excitation multipulses, namely, the first through the fourth amplitudes at the first through the fourth subframes sf1 to sf4, along with the judged signal DS representative of the unvoiced sound information. Thus, the pulse calculator 26 does not calculate the locations of the second set of excitation multipulses because the locations of the second set of excitation multipulses are determined at intervals of the preselected number K of samples. As a result, the pulse calculator 26 produces the second set of excitation multipulses which are equal to twice or three times, in number, relative to the conventional pulse calculator described in the third reference regardless of the frame having the unvoiced sound. For example, if the encoder device is used at a bit rate of 6000 bit/sec, the pulse calculator 26 can produce the second set of excitation multipulses of twenty per a single frame having a time interval of 20 milliseconds even if the frame has the unvoiced sound. The cross-correlator 23, the impulse response calculator 24, the autocorrelator 25, and the pulse calculator 26 may be collectively called a processing unit.

On reception of the judged signal representative of the voiced sound information, a quantizer 27 quantizes the first set of primary sound source signals into a first set of quantized primary sound source signals and supplies the first set of quantized primary sound source signals to the multiplexer 13. Subsequently, the quantizer 27 converts the first set of quantized primary sound source signals into a first set of converted primary sound source signals by inverse conversion relative to the above-described quantization and delivers the first set of converted primary sound source signals to a pitch synthesis filter 28. Supplied with the first set of converted primary sound source signals together with the judged signal DS representative of the voiced sound information and the second parameter signals representative of the pitch period and the pitch coefficients, the pitch synthesis filter 28 reproduces a first set of pitch synthesized primary sound source signals in accordance with the pitch coefficients and the pitch period and supplies the first set of pitch synthesized primary sound source signals to a synthesis filter 29. The synthesis filter 29 synthesizes the first set of pitch synthesized primary sound source signals by the use of the converted spectrum parameters $a_i'$ and produces a first set of synthesized primary sound source signals.

On the other hand, the quantizer 27 quantizes the second set of secondary sound source signals into a second set of quantized secondary sound source signals and supplies the second set of quantized secondary sound source signals to the multiplexer 13 on reception of the judged signal DS representative of the unvoiced sound information. Subsequently, the quantizer 27 converts the second set of quantized secondary sound source signals into a second set of converted secondary sound source signals and delivers the second set of converted secondary sound source signals to the synthesis filter 29. The synthesis filter 29 synthesizes the second set of converted secondary sound source signals by the use of the converted spectrum parameters $a_i'$ and produces a second set of synthesized secondary sound source signals. The first set of primary sound source signals and the second set of secondary sound source signals are collectively called the local synthesized speech signals X'(n) of a current frame as described before. The local synthesized speech signals are used for the input digital speech signals of a next frame following the current frame.

The multiplexer 13 multiplexes the quantized spectrum parameters, the quantized pitch period, the quantized pitch coefficients, the judged signal, the first set of quantized primary sound source signals representative of the locations and the amplitudes of the first set of excitation multipulses, and the second set of quantized secondary sound source signals representative of the amplitudes of the second set of the excitation multipulses and the initial phases of the respective subframes into a sequence of multiplexed signals and produces the multiplexed signal sequence as the output signal sequence OUT. The multiplexer 13 serves as an output signal producing unit.

Figure 4:
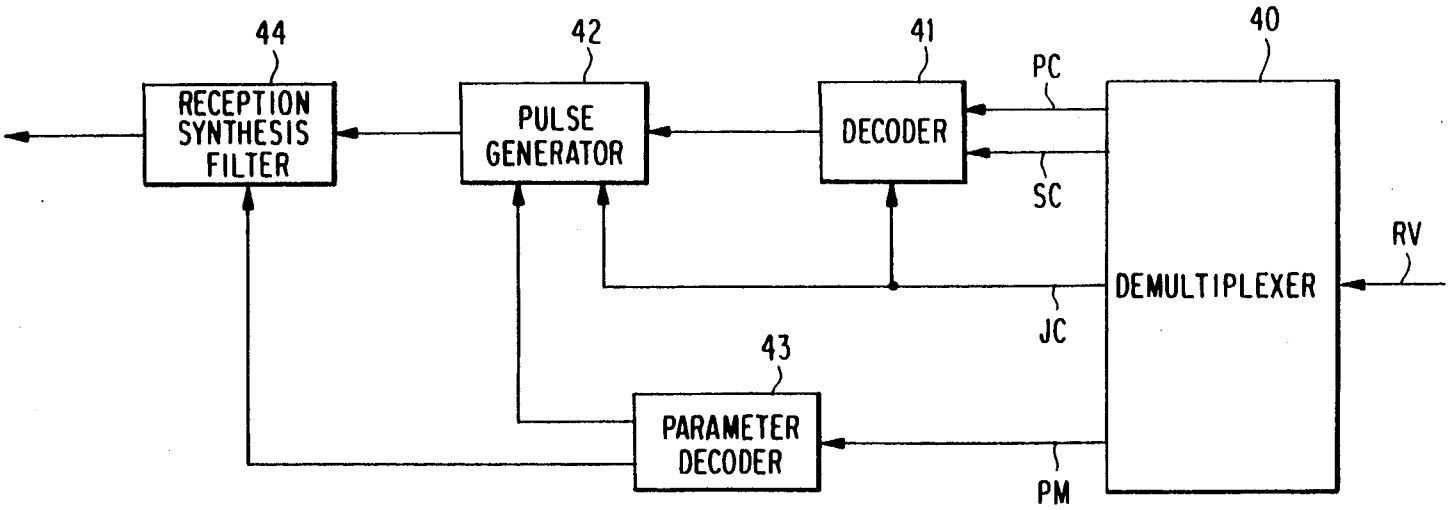
FIG. 4 is a block diagram of a decoder device which is communicable with the encoder device illustrated in FIG. 1 to form a communication system along with the encoder device.

Referring to FIG. 4, a decoding device is communicable with the encoding device illustrated in FIG. 1 and is supplied as a sequence of reception signals RV with the output signal sequence OUT shown in FIG. 1. The reception signals RV are given to a demultiplexer 40 and demultiplexed into a first set of primary sound source codes, a second set of secondary sound source codes, judged codes, spectrum parameter codes, pitch period codes, and pitch coefficient codes which are all transmitted from the encoding device illustrated in FIG. 1. The first set of primary sound source codes and the second set of secondary sound source codes are depicted at PC and SC, respectively. The judged codes are depicted at JC. The spectrum parameter codes, pitch period codes, and the pitch coefficient codes may be collectively called parameter codes and are collectively depicted at PM. The first set of primary sound source codes PC include the first set of primary sound source signals while the second set of secondary sound source codes SC include the second set of secondary sound source signals. The parameter codes PM include the first and the second parameter signals. The judged codes JC include the judged signal. The first parameter signal carries the spectrum parameter while the second parameter signal carries the pitch period and the pitch coefficients. The judged signal carries the voiced sound information and the unvoiced sound information. The first set of primary sound source signals carry the locations and the amplitudes of the first set of excitation multipulses while the second set of secondary sound source signals carry the amplitudes of the second set of secondary excitation multipulses and the initial phases of the respective subframes.

Supplied with the first set of primary sound source codes PC and the judged codes representative of the voiced sound information, a decoder 41 reproduces decoded locations and amplitudes of the first set of excitation multipulses carried by the first set of primary sound source codes PC and delivers the decoded locations and amplitudes of the first set of excitation multipulses to a pulse generator 42. Such a reproduction of the first set of excitation multipulses is carried out during the voiced sound duration. The decoder 41 reproduces decoded amplitudes of the second set of secondary excitation multipulses and decoded initial phases carried by the second set of secondary sound source codes SC on reception of the judged codes representative of the unvoiced sound information. The decoded amplitudes of the second set of secondary excitation multipulses and the decoded initial phases are also supplied to the pulse generator 42.

Supplied with the parameter codes PM, a parameter decoder 43 reproduces decoded spectrum parameters, decoded pitch period, and decoded pitch coefficients. The decoded pitch period and the decoded pitch coefficients are supplied to the pulse generator 42 while the decoded spectrum parameters are delivered to a reception synthesis filter 44. The parameter decoder 43 may be similar to the inverse quantizer 14 illustrated in FIG. 1. Supplied with the decoded locations and amplitudes of the first set of excitation multipulses and the judged codes JC representative of the voiced sound information, the pulse generator 42 generates a reproduction of the first set of excitation multipulses with reference to the decoded pitch period and the decoded pitch coefficients and supplies a first set of reproduced excitation multipulses to the reception synthesis filter 44 as a first set of driving sound source signals. Supplied with the decoded amplitudes of the second set of excitation multipulses, the decoded initial phases, and the judged codes JC representative of the unvoiced sound information, the pulse generator 42 generates a reproduction of the second set of excitation multipulses at intervals of a preselected number K of samples by the use of the decoded initial phases and the decoded pitch period and supplies a second set of reproduced excitation multipulses to the reception synthesis filter 44 as a second set of driving sound source signals. The reception synthesis filter 44 synthesizes the first set of driving sound source signals and the second set of driving sound source signals into a sequence of synthesized speech signals at every frame by the use of the decoded spectrum parameters. The reception synthesis filter 44 is similar to that described in the third reference.

Figure 5:
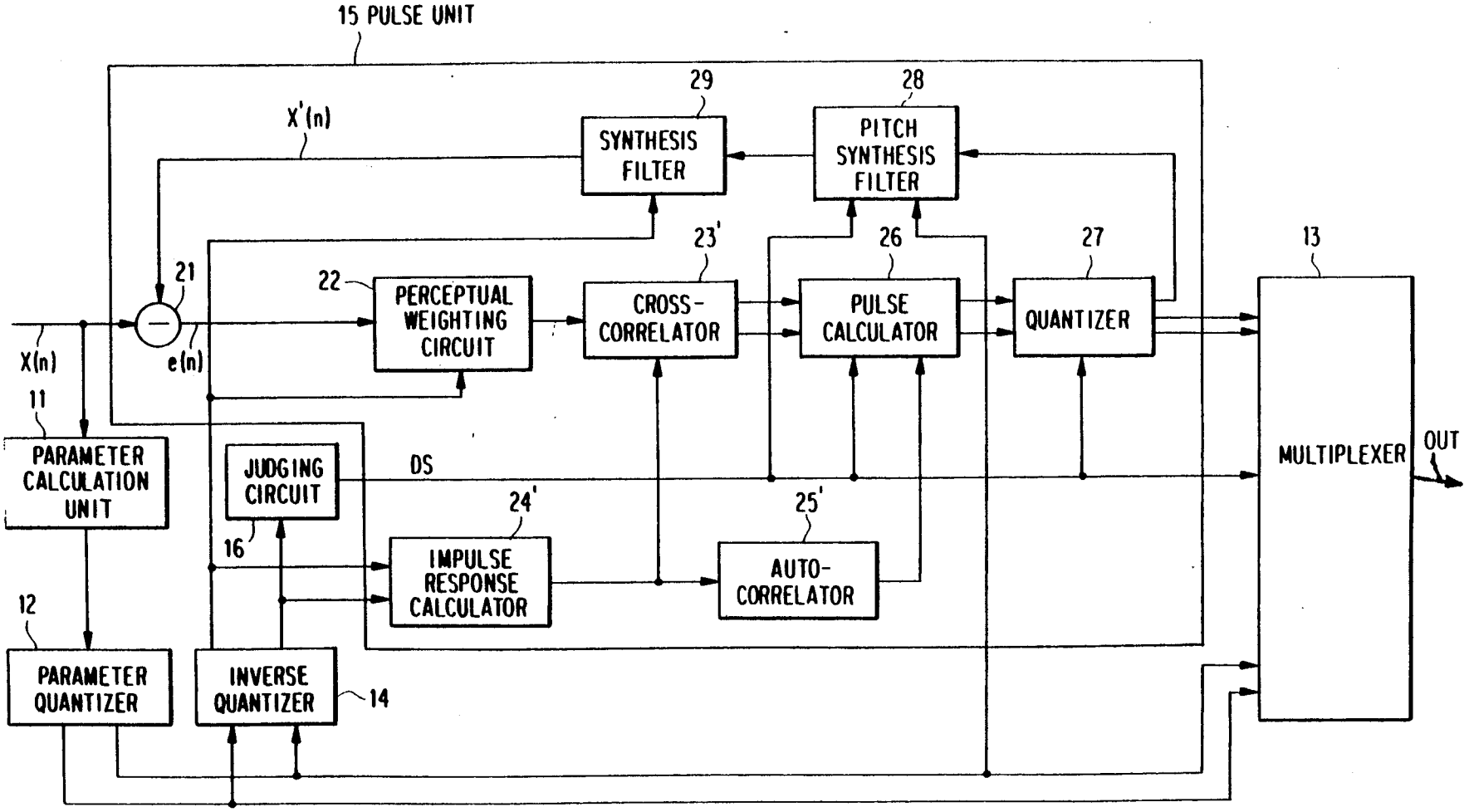
FIG. 5 is a block diagram of an encoder device according to a second embodiment of this invention.

Referring to FIG. 5, an encoder device according to a second embodiment of this invention is similar to that illustrated in FIG. 1 except for a cross-correlator 23', an impulse response calculator 24', and an autocorrelator 25'. The encoder device is supplied with a sequence of input digital speech signals X(n) to produce a sequence of output signals OUT. The input digital speech signal sequence X(n) is divisible into a plurality of frames and is assumed to be sent from an external device, such as an analog-to-digital converter (not shown) to the encoder device. Each frame may have an interval of, for example, 20 milliseconds. The input digital speech signals X(n) is supplied to the parameter calculation unit 11 at every frame. The parameter calculation unit 11 comprises the LPC analyzer (not shown) and the pitch parameter calculator (not shown) both of which are given the input digital speech signals X(n) in parallel to calculate the spectrum parameters $a_i$, namely, the LPC parameters, and the pitch parameters.

The LPC analyzer analyzes the input digital speech signals to calculate first through P-th orders of spectrum parameters. The spectrum parameters calculated in the LPC analyzer are sent to the parameter quantizer 12 and are quantized into quantized spectrum parameters each of which is composed of a predetermined number of bits. The quantized spectrum parameters are delivered to the multiplexer 13. Furthermore, the quantized spectrum parameters are converted by the inverse quantizer 14 which carries out inverse quantization relative to quantization of the parameter quantizer 12 into the converted spectrum parameters $a_i'$ ($i=1\sim P$). The converted spectrum parameters $a_i'$ are supplied to the pulse calculation unit 15. The quantized spectrum parameters and the converted spectrum parameters $a_i'$ come from the spectrum parameters calculated by the LPC analyzer and are produced in the form of electric signals which may be collectively called a first parameter signal.

In the parameter calculation unit 11, the pitch parameter calculator calculates the average pitch period M and the pitch coefficients b from the input digital speech signals X(n) to produce, as the pitch parameters, the average pitch period M and the pitch coefficients b at every frame by an autocorrelation method. The average pitch period M and the pitch coefficients b are also quantized by the parameter quantizer 12 into a quantized pitch period and quantized pitch coefficients each of which is composed of a preselected number of bits. The quantized pitch period and the quantized pitch coefficients are sent as electric signals. In addition, the quantized pitch period and the quantized pitch coefficients are also converted by the inverse quantizer 14 into the converted pitch period M' and the converted pitch coefficients b' which are produced in the form of electric signals. The quantized pitch period and the quantized pitch coefficients are sent to the multiplexer 13 as a second parameter signal representative of the pitch period and the pitch coefficients.

By the use of the converted pitch coefficients b', the judging circuit 16 judges whether the input digital speech signals X(n) are classified into the voiced sound or the unvoiced sound at every frame. More exactly, the judging circuit 16 compares the converted pitch coefficients b' with a predetermined level at every frame and produces the judges signal DS at every frame. The judging circuit 16 produces the judged signal DS representative of voiced sound information when the converted pitch coefficients b' is higher than the predetermined level. Otherwise, the judging circuit 16 produces the judged signal DS representative of unvoiced sound information. The judged signal DS is supplied to the pulse calculation unit 15.

In the example being illustrated, the pulse calculation unit 15 is supplied with the input digital speech signals X(n) at every frame along with the converted spectrum parameters $a_i'$, the converted pitch period M', the converted pitch coefficients b', and the judged signal DS to selectively produce a first set of primary sound source signals and a second set of secondary sound source signals different from the first set of primary sound source signals. To this end, the pulse calculation unit 15 comprises the subtracter 21 responsive to the input digital speech signals X(n) and the local synthesized speech signals X'(n) to produce the error signals e(n) representative of differences between the input digital and the local synthesized speech signals X(n) and X'(n). The error signals e(n) are sent to the perceptual weighting circuit 22 which is supplied with the converted spectrum parameters $a_i'$. In the perceptual weighting circuit 22, the error signals e(n) are weighted by weights which are determined by the converted spectrum parameters $a_i'$. Thus, the perceptual weighting circuit 22 calculates a sequence of weighted errors in a known manner to supply the weighted errors $X_w(n)$ to the cross-correlator 23'.

On the other hand, the converted spectrum parameters $a_i'$ are also sent from the inverse quantizer 14 to the impulse response calculator 24'. The impulse response calculator 24' calculates an impulse response $h_w'(n)$ of a filter having a transfer function H'(Z) specified by the following equation by the use of the converted spectrum parameters $a_i'$, the converted pitch period M', and the converted pitch coefficients b'.

$$H(Z)=W(Z)/\{(1-b'Z^{-M'})(1-\Sigma a_i'Z^{-i})\},$$

where W(Z) represents a transfer function of the perceptual weighting circuit 22. The impulse response $h_w'(n)$ thus calculated is delivered to both the cross-correlator 23' and the autocorrelator 25' in the form of an electric signal which may be called an impulse response signal.

The autocorrelator 25' calculates autocorrelation coefficients R(m) by the use of the impulse response $h_w'(n)$ in accordance with the following equation given by:

$$R(m) = \sum_{n=0}^{N-1} h_w'(n+m)h_w'(n),$$

where m is specified by ($0 \leqq m \leqq N-1$). The autocorrelation coefficients R(m) are produced in the form of an electric signal which may be called an autocorrelation signal.

When the cross-correlator 23' is supplied with the weighted errors $X_w(n)$ and the autocorrelation coefficients R(m), the cross-correlator 23' calculates cross-correlation coefficients Φ(m) for a predetermined number of N samples in accordance with the following equation given by:

$$\Phi(m) = \sum_{n=0}^{N-1} X_w(n+m)h_w'(n).$$

The cross-correlation coefficients Φ(m) are delivered to the pulse calculator 26 in the form of an electric signal which may be called a cross-correlation signal.

On reception of the judged signal DS representing the voiced sound information, the pulse calculator 26 calculates locations and amplitudes of a first set of excitation multipulses by a pitch prediction multipulse encoding method by the use of the cross-correlation coefficients Φ(m) and the autocorrelation coefficients R(m). When the pulse calculator 26 receives the judged signal DS representative of the unvoiced sound information, the pulse calculator 26 calculates amplitudes of a second set of excitation multipulses each of which is located at intervals of a preselected number of K samples in the manner described in conjunction with FIGS. 2 and 3.

The pulse calculator 26 produces a first set of primary sound source signals representative of the locations and the amplitudes of the first set of excitation multipulses along with the judged signal DS representative of the voiced sound information. The pulse calculator 26 also produces a second set of secondary sound source signals representative of the initial phases and the amplitudes of a second set of excitation multipulses of the respective subframes along with the judged signal DS representative of the unvoiced sound information.

On reception of the judged signal DS representative of the voiced sound information, the quantizer 26 quantizes the first set of primary sound source signals into a first set of quantized primary sound source signals which are composed of a first predetermined number of bits and supplies the first set of quantized primary sound source signals to the multiplexer 13. Subsequently, the quantizer 27 converts the first set of quantized primary sound source signals into a first set of converted primary sound source signals by inverse conversion relative to the above-described quantization and delivers the first set of converted primary sound source signals to the pitch synthesis filter 28. Supplied with the first set of converted primary sound source signals together with the second parameter signal representative of the pitch period and the pitch coefficients, the pitch synthesis filter 28 reproduces a first set of pitch synthesized primary sound source signals in accordance with the pitch coefficients and the pitch period and supplies the first set of pitch synthesized primary sound source signals to the synthesis filter 29. The synthesis filter 29 synthesizes the first set of pitch synthesized primary sound source signals by the use of the converted spectrum parameters $a_i'$ and produces a first set of synthesized primary sound source signals.

On the other hand, the quantizer 27 quantizes the second set of secondary sound source signals into a second set of quantized secondary sound source signals which are composed of the first predetermined number of bits and supplies the second set of quantized secondary sound source signals to the multiplexer 13 on reception of the judged signal DS representative of the unvoiced sound information. Subsequently, the quantizer 27 converts the second set of quantized secondary sound source signals into a second set of converted secondary sound source signals and delivers the second set of converted secondary sound source signals to the synthesis filter 29. The synthesis filter 29 synthesizes the second set of converted secondary sound source signals by the use of the converted spectrum parameters $a_i'$ and produces a second set of synthesized secondary sound source signals. The first set of primary sound source signals and the second set of secondary sound source signals are collectively called the local synthesized speech signals X'(n) of a current frame as described before. The local synthesized speech signals are used for the input digital speech signals of a next frame following the current frame.

The multiplexer 13 multiplexes the quantized spectrum parameters, the quantized pitch period, the quantized pitch coefficients, the judged signal, the first set of quantized primary sound source signals representative of the locations and the amplitudes of the first set of excitation multipulses, and the second set of quantized secondary sound source signals representative of the amplitudes of the second set of the excitation multipulses and the initial phases of the respective subframes into a sequence of multiplexed signals and produces the multiplexed signal sequence as the output signal sequence OUT.

The pulse calculation unit 15 may use other manners for calculating the amplitudes of the second set of excitation multipulses when the judged signal DS representative of the unvoiced sound information. For example, the pulse calculation unit 15, at first, carries out a pitch prediction for the input digital speech signals X(n) in accordance with the following equation given by:

$$e(n)=X(n)-b'X(n-M').$$

Next, the impulse response calculator 24' calculates an impulse response $h_s(n)$ of a filter having a transfer function $H_s(Z)$ given by the following equation by the use of the converted spectrum parameters $a_i'$.

$$H_s(Z) = W(Z)/\left\{1 - \sum_{i=1}^{P} a_i' Z^{-1}\right\}$$

The autocorrelator 25' calculates an autocorrelation coefficients R'(m) in accordance with the following equation given by:

$$R'(m) = \sum_{n=0}^{N-1} h_s(n+m)h_s(n). \tag{4}$$

The cross-correlator 23' calculates, by the use of the converted spectrum parameters $a_i'$, a cross-correlation coefficients Φ'(m) for the error signals e(n) in accordance with the following equation given by:

$$\Phi'(m) = \sum_{n=0}^{N-1} e(n+m)h_s(n). \tag{5}$$

The pulse calculator 26 calculates the amplitudes of the second set of excitation multipulses by the use of the autocorrelation coefficients R'(m) and the cross-correlation coefficients Φ'(m) in the manner described in conjunction with FIGS. 2 and 3.

By way of another example, the pulse calculation unit 15 comprises an inverse filter to which the input digital speech signals is supplied and calculates a sequence of prediction error signals d(n) in accordance with the following equation given by:

$$d(n) = X(n) = \sum_{i=1}^{P} a_i'X(n-i). \tag{6}$$

Next, the pulse calculator 26 calculates the error signals e(n) by a pitch prediction method for the prediction error signals d(n) in accordance with the following equation given by:

$$e(n)=d(n)-b'e(n-M'). \tag{7}$$

The cross-correlator 23' calculates a cross-correlation coefficients Φ''(m) of the error signals e(n) in accordance with the above-mentioned equation (5). The autocorrelator 25' calculates an autocorrelation coefficients R''(m) by the use of the above-described equation (4). The pulse calculator 26 calculates the amplitudes of the second set of excitation multipulses by the use of the autocorrelation coefficients R''(m) and the cross-correlation coefficients Φ''(m) in the manner described in conjunction with FIGS. 2 and 3. In the equations (6) and (7), the pitch coefficients b' and the pitch period M' may be calculated whichever in each frame and in each subframe which is shorter than the frame.

A decoder device which is operable as a counterpart of the encoder device illustrated in FIG. 5 can use the decoder device illustrated in FIG. 4.

While this invention has thus far been described in conjunction with a few embodiments thereof, it will readily be possible for those skilled in the art to put this invention into practice in various other manners. For example, the pitch coefficients b may be calculated in accordance with the following equation given by:

$$E = \sum_{n}^{N} [\{X(n) - b \cdot v(n - T) * h_s(n)\} * w(n)]^2,$$

where * represents convolution v(n), represents previous sound source signals reproduced by the pitch synthesis filter and the synthesis filter and E, an error power between the input digital speech signals of an instant subframe and the previous subframe. In this event, the parameter calculator searches a location T which minimizes the above-described equation. Thereafter, the parameter calculator calculates the pitch coefficients b in accordance with the location T. The synthesis filter may reproduce weighted synthesized signals. The calculation of the first set of excitation multipulses in the voiced sound duration may use other manners. For example, the pulse calculation unit, at first, calculates a first set of primary excitation multipulses by the pitch prediction multipulse method, and then calculates a second set of secondary excitatioin multipulses by a conventional multipulse search method without pitch prediction in the manner described in Japanese Patent Application No. Syô 63-147253, namely, 147253/1988.

What is claimed is:

1. An encoder device supplied with a sequence of digital speech signals at every frame to produce a sequence of output signals, each frame having N samples per a single frame where N represents an integer, said digital speech signals being classified into a voiced sound and an unvoiced sound, said encoder device comprising parameter calculation means responsive to said digital speech signals for calculating first and second parameters which specify a spectrum envelope and a pitch of the digital speech signals at every frame to produce first and second parameter signals representative of said spectrum envelope and said pitch, respectively, pulse calculation means coupled to said parameter calculation means for calculating a set of calculation result signals representative of said digital speech signals, and output signal producing means for producing said set of the calculation result signals as said output signal sequence, wherein the improvement comprises:

judging means operable in cooperation with said parameter calculation means for judging whether said digital speech signals are classified into said voiced sound or said unvoiced sound at every frame to produce a judged signal representative of a result of judging said digital speech signals;

said pulse calculation means comprising:

processing means supplied with said digital speech signals, said first and said second parameter signals, and said judged signal for processing said digital speech signals in accordance with said judged signal to selectively produce a first set of primary sound source signals and a second set of secondary sound source signals different from said first set of the primary sound source signals, said first set of the primary sound source signals being representative of locations and amplitudes of a first set of excitation multipulses calculated at every frame, said second set of the secondary sound source signals being representative of the amplitudes of a second set of excitation multipulses each of which is located at intervals of a preselected number of the samples; and means for supplying a combination of said first and said second parameter signals, said judged signal, and said primary and said secondary sound source signals to said output signal producing means.

2. An encoder device as claimed in claim 1, wherein said processing means produces said first set of the primary sound source signals when said judged signal is representative of said voiced sound and, otherwise, produces said second set of the secondary sound source signals.

3. An encoder device as claimed in claim 1, wherein said judging means compares said pitch with a predetermined level to judge whether said speech signal is classified into the voiced sound or the unvoiced sound.

4. An encoder device as claimed in claim 1, each frame being divided into a predetermined number of subframes each of which has a predetermined duration, wherein said processing means calculates, in response to said judged signal representative of said unvoiced sound, amplitudes of a plurality of excitation multipulses and an initial phase of a first excitation multipulse located at a head of said plurality of the excitation multipulses in each of said subframes by the use of said first parameters, said processing means producing a sequence of said initial phases of said subframes and a sequence of said plurality of excitation multipulses of said subframes as said second set of secondary sound source signals.

5. An encoder device as claimed in claim 4, wherein said processing means comprises:

impulse response calculating means responsive to said first and said second parameter signals and said judged signal for calculating a primary impulse response by the use of said first and said second parameters when said judged signal represents said voiced sound and for calculating a secondary impulse response by the use of said first parameter when said judged signal represents said unvoiced sound to selectively produce a primary impulse response signal representative of said primary impulse response and a secondary impulse response signal representative of said secondary impulse response;

cross-correlation calculating means responsive to said digital speech signals, said primary and said secondary impulse response signals, and said judged signal for calculating primary cross-correlation coefficients by the use of said primary impulse response when said judged signal represents said voiced sound and for calculating secondary cross-correlation coefficients by the use of said secondary impulse response when said judged signal represents said unvoiced sound to selectively produce a primary cross-correlation signal representative of said primary cross-correlation coefficients and a secondary cross-correlation signal representative of said secondary cross-correlation coefficients;

autocorrelation calculating means responsive to said primary and said secondary impulse response signal for calculating primary autocorrelation coefficients by the use of said primary impulse response and for calculating secondary autocorrelation coefficients by the use of said secondary impulse response to selectively produce a primary autocorrelation signal representative of said primary autocorrelation coefficients and a secondary autocorrelation signal representative of said secondary autocorrelation coefficients; and a pulse calculator responsive to said judged signal, said primary and said secondary cross-correlation signals, and said primary and said secondary autocorrelation signals for calculating the locations and the amplitudes of said first set of the excitation multipulses by the use of said primary cross-correlation and autocorrelation coefficients at every frame when said judged signal represents said voiced sound and for calculating the amplitudes of said plurality of excitation multipulses and the initial phase of said first excitation multipulse by the use of said secondary cross-correlation and autocorrelation coefficients in each of said subframes when said judged signal represents said unvoiced sound to selectively produce the locations and the amplitudes of said first set of the excitation multipulses as said primary sound source signals and said sequence of the initial phases of said subframes and said sequence of the plurality of excitation multipulses of said subframes as said second set of secondary sound source signals.

6. An encoder device as claimed in claim 1, wherein said processing means calculates, in response to said judged signal representative of said unvoiced sound, amplitudes of a plurality of excitation multipulses and an initial phase of a first excitation multipulse located at a head of said plurality of excitation multipulses in each of subframes, which result from dividing every frames and each of which is shorter than said frame, by the use of cross-correlation coefficients specified by said first parameters and said second parameters, said processing means producing a sequence of said initial phases of said subframes and a sequence of said excitation multipulses of said subframes as said second set of secondary sound source signals.

7. An encoder device as claimed in claim 6, said processing means comprises;

impulse response calculating means responsive to said first and said second parameter signals for calculating an impulse response by the use of said first and said second parameters to produce an impulse response signal representative of said impulse response;

cross-correlation calculating means responsive to said digital speech signals, and said impulse response signal for calculating cross-correlation coefficients by the use of said impulse response to produce a cross-correlation signal representative of said cross-correlation coefficients;

autocorrelation calculating means responsive to said impulse response signal for calculating autocorrelation coefficients by the use of said impulse response to produce an autocorrelation signal representative of said autocorrelation coefficients; and a pulse calculator responsive to said judged signal, said cross-correlation signals, and said autocorrelation signals for calculating the locations and the amplitudes of said first set of the excitation multipulses by the use of said cross-correlation and autocorrelation coefficients at every frame when said judged signal represents said voiced sound and for calculating the amplitudes of said plurality of excitation multipulses and the initial phase of said first excitation multipulse by the use of said cross-correlation and autocorrelation coefficients in each of said subframes when said judged signal represents said unvoiced sound to selectively produce the locations and the amplitudes of said first set of the excitation multipulses as said primary sound source signals and said sequence of the initial phases of said subframes and said sequence of the plurality of excitation multipulses of said subframes as said second set of secondary sound source signals.

8. A decoder device communicable with the encoder device claimed in claim 1 to produce a sequence of synthesized speech signals, said decoder device being supplied with said output signal sequence as a sequence of reception signals which carries said first set of the primary sound source signals, said second set of the secondary sound source signals, said first and said second parameter signals, and said judged signal, said decoder device comprising:

demultiplexing means supplied with said reception signal sequence for demultiplexing said reception signal sequence into the first set of primary sound source signals, the second set of secondary sound source signals, the first and the second parameter signals, and the judged signals as a first set of primary sound source codes, a second set of secondary sound source codes, first and second parameter codes, and judged codes, respectively;

decoding means coupled to said demultiplexing means for decoding said first set of the primary sound source codes into a first set of decoded primary sound source signals when said judged codes are representative of said voiced sound and for decoding said second set of secondary sound source codes into a second set of decoded secondary sound source signals when said judged codes are representative of said unvoiced sound;

parameter decoding means coupled to said demultiplexing means for decoding said first and said second parameter codes into first and second decoded parameters, respectively;

pulse generating means coupled to said demultiplexing means, said decoding means, and said parameter decoding means for generating a first set of driving sound source signals by the use of said decoded second parameters when said judged signal is representative of said voiced sound and for generating a second set of driving source signals by the use of said decoded second parameters when said judged signal is representative of said unvoiced sound; and means coupled to said pulse generating means and said parameter decoding means for synthesizing said first set and said second set of the driving sound source signals into said synthesized speech signals by the use of said first decoded parameters.

* * * * *

UNITED STATES PATENT AND TRADEMARK OFFICE

CERTIFICATE OF CORRECTION

PATENT NO. : 5,091,946

DATED : February 25, 1992

INVENTOR(S) : Kazunori Ozawa

It is certified that error appears in the above-indentified patent and that said Letters Patent is hereby corrected as shown below:

Col. 7, line 39, after "($m_i$)" delete "=" and insert -- - --;

Col. 7, line 42, delete "ini-ial" and insert --initial--.

Signed and Sealed this

Nineteenth Day of October, 1993

Bruce Lehman

*Attest:*

BRUCE LEHMAN

*Attesting Officer*

*Commissioner of Patents and Trademarks*